US008141190B2

(12) United States Patent
Robidoux

(10) Patent No.: US 8,141,190 B2
(45) Date of Patent: Mar. 27, 2012

(54) WALK-UP WORKSTATION EMPLOYING IONIZING AIR NOZZLES AND INSULATING PANELS

(75) Inventor: Roger Robidoux, Southbridge, MA (US)

(73) Assignee: Gentex Optics, Inc., Simpson, PA (US)

( * ) Notice: Subject to any disclaimer, the term of this patent is extended or adjusted under 35 U.S.C. 154(b) by 895 days.

(21) Appl. No.: 12/180,928

(22) Filed: Jul. 28, 2008

(65) Prior Publication Data

US 2010/0017977 A1 Jan. 28, 2010

(51) Int. Cl.
*A47L 9/02* (2006.01)
*A47L 13/40* (2006.01)

(52) U.S. Cl. ..... 15/1.51; 15/1.52

(58) Field of Classification Search ..... 15/1.51, 15/1.52; *A47L 9/02, 13/40*
See application file for complete search history.

(56) References Cited

U.S. PATENT DOCUMENTS

| | | | | |
|---|---|---|---|---|
| 3,179,849 | A | 4/1965 | Schweriner | |
| 4,132,567 | A | 1/1979 | Blackwood | |
| 4,137,567 | A * | 1/1979 | Grube | 702/175 |
| 4,364,147 | A | 12/1982 | Biedermamm et al. | |
| 4,665,462 | A | 5/1987 | Blitshteyn et al. | |
| 4,740,248 | A * | 4/1988 | Thro et al. | 134/21 |
| 4,751,759 | A | 6/1988 | Zoell | |
| 5,055,963 | A | 10/1991 | Patridge | |
| 5,114,740 | A * | 5/1992 | Plate et al. | 427/533 |
| 5,187,635 | A * | 2/1993 | Yehl | 361/231 |
| 5,351,354 | A * | 10/1994 | Hasumi et al. | 15/1.51 |
| 5,388,769 | A * | 2/1995 | Rodrigo et al. | 239/690 |
| 5,557,820 | A * | 9/1996 | Belanger et al. | 15/1.51 |
| 6,002,573 | A | 12/1999 | Partridge | |
| 6,252,233 | B1 | 6/2001 | Good | |
| 7,134,946 | B1 | 11/2006 | Jackson | |
| 2006/0176642 | A1 | 8/2006 | George et al. | |
| 2007/0157402 | A1 | 7/2007 | Caffarella | |
| 2009/0158537 | A1 * | 6/2009 | Ishijima et al. | 15/1.51 |

OTHER PUBLICATIONS

The Simco Company, Inc. Simco Industrial Static Control, "Ionizing Air Nozzles—A powerful stream of ionized air," 2 pgs., Sep. 2002 (www.simco-static.com).
The Simco Company, Inc. Simco Industrial Static Control, "Static Control Nozzles—HE Static Control Nozzle," 1 pg. (www.simco-static.com).
The Simco Company, Inc. Simco Industrial Static Control, "HE Nozzle," (drawing) 1 pg. (www.simco-static.com).
The Simco Company, Inc. Simco Industrial Static Control, "Static Control Nozzles—HS Static Control Nozzle," 1 pg. (www.simco-static.com).
The Simco Company, Inc. Simco Industrial Static Control, "HS Nozzle," (drawing) 1 pg. (www.simco-static.com).
The Simco Company, Inc. Simco Industrial Static Control, "Power Supplies for Static Control Products," 1 pg., (www.simco-static.com).
The Simco Company, Inc. Simco Industrial Static Control, "HE Ionizing Nozzle," 1 pg., 2006 (www.simco-static.com).
The Simco Company, Inc. Simco Industrial Static Control, "Warranty and Returns," 1 pg., (www.simco-static.com).
Compression Polymers Corp. and Vycom Corp., "Seaboard Premier Typical Properties," 1 pg., 2007 (www.cpg-vycom.com).

* cited by examiner

*Primary Examiner* — David Redding
(74) *Attorney, Agent, or Firm* — Keusey & Associates, P.C.

(57) ABSTRACT

A walk-up, user accessible cleaning workstation having a sensor and ionization nozzle arranged on a frame. The frame mounts the sensor in a fixed position to the nozzle in operative proximity to a cleaning area. The frame partially encloses the nozzle's electrode. The sensor detects manual workpiece placement into the cleaning area to open the gas valve and activate the power supply. The panel deflects dust flying off the workpiece from reaching the user's face. The workstation improves safety in the cleaning and destaticizing of ophthalmic lenses.

16 Claims, 4 Drawing Sheets

Fig. 1 *(Prior Art)*

WALK-UP WORKSTATION EMPLOYING IONIZING AIR NOZZLES AND INSULATING PANELS

BACKGROUND

1. Technical Field

The present invention relates generally to a user accessible destaticizing and cleaning workstation, having auto-start capabilities.

2. Description of Related Art

Non-conductive materials or objects, such as plastic lenses, can carry electric charges creating unwanted static on the surface thereof and thus can attract dust particles or other contaminants. Air ionization is a common and effective method of reducing and removing static charges on such materials. In typical air ionizers, high voltages are applied to pointed electrodes, thus charging air particles around the electrodes. Positive and negative ions are produced through this process of corona discharge and serve as mobile carriers of charge in the air. With the use of air current caused by blowers or compressed air, the positive and negative ions are projected to a designated location. Neutralization occurs when these positive and negative ions attract to oppositely charged particles on the surfaces of these non-conductive objects in which are placed at the designated location.

Numerous methods and apparatuses have been fashioned to eliminate such static charges in conjunction with ionization blowers and/or nozzles as well as compressed air and/or air from the surrounding area or environment.

Such technology is disclosed, for example, in U.S. Pat. No. 5,114,740. The patent discloses a conveyor line to transmit injection molded plastic lenses through a deionizing station to a coating station. The ionization source is a standard ionizing blower. In addition, U.S. Pat. No. 4,740,248 exemplifies an ionization device that utilizes gas flow stations and a vacuum to remove any contaminants on the surface of lenses between the two disclosed stations.

U.S. Patent Application Publication No. 2006/0176642 describes an ionizer that primarily intakes ambient air and deionizes the same with the ionization blowers. The device's principal use is to reduce the amount of statically charged air around fuel dispensers, for example, gas stations.

In addition to work stations, ionization "guns" have been fashioned to complete similar tasks as those of the work station while maintain the ability to be a portable device. U.S. Pat. No. 5,388,769, to Rodrigo, describes a "Self Cleaning Ionizing Air Gun", where multiple compressed air ports direct high velocity air into the barrel of an ionizer, drawing additional atmospheric air into the barrel from the open back end of the ionizer barrel.

U.S. Patent Application Publication No. 2007/0157402 to Caffarella, illustrates a method for a portable nuclear and/or electric ionizer. The device is devised with a compressible air chamber which acts like a hand pump. When squeezed, the ionized air blower expels a high stream of air over the ionizer and out of the device through a nozzle. Of particular note, the device is noted to be self-contained and does not require a connection to an external air source.

Other ionization devices have been specifically designed in order to provide a means for clean compressible air. For the reason that ambient air can contain statically charged particles, these devices allow the flow of clean pressurized air to flow within the ionization device. Several examples of such ionization devices are disclosed in U.S. Pat. Nos. 3,179,849 and 5,351,354.

U.S. Pat. No. 3,179,849 is a "Shockless Ionizing Air Nozzle" illustrating an ionizing air gun. The device features an electrode enclosed in the gun's barrel powered by an A.C. high voltage power supply. Compressed air is supplied to the gun through a cable which is then piloted to the electrode needle.

U.S. Pat. No. 5,351,354 represents an electrical ionizer used in conjunction with a conveyer belt. When the object enters the device a "start" sensor activates the compressed air in order to remove contaminants from the surfaces of the objects by an array of ionization nozzles displayed on the same side as the object support means.

Several apparatuses have been produced in order to maintain a statically neutral environment for a specific object during the neutralization process. Chambers have been created in order to partially isolate the object while being sprayed with the ionized air so that particles from ambient air do not contaminate the surface of the object. Materials such a plexiglass, as in U.S. Pat. No. 5,114,740, and netting, as in U.S. Pat. No. 5,351,354, have been disclosed.

U.S. Pat. No. 4,132,567 illustrates a pipe that carries pressurized nitrogen gas to an ionization nozzle. The electrical line and ground wire are spaced from the pipe within a hollow cover. The material forming cover is not specified.

In accordance with neutralizing, the production and flow of ion content of both the positive and negative ions needs to be equivalent to one another. As stated, neutralization is the process in which positive and negative ions bond to one another to create a neutral charge. If an unequal amount of either ion is produced, there will still be an unwanted charge at the desired location. For example, if more ions with a negative charge are produced at the ionization nozzle, there will be an insufficient amount of positive ions to bond to those negative ions, thus leaving negative charge in the respective area. Neutralization would not occur. Therefore, it is of major importance that air ionizers produce a balanced number of positive and negative ions.

One method to balancing the ion content so that "unbalancing" of the ions does not occur is to minimize the exposed surface area of the grounded components of the ionizer It is known that particles, such as dust itself, can be attracted to the metal electrodes of the ionizer and therefore can cause the ionizer to "burn out". Additionally, the ion content in that particular region can become unbalanced, thus creating a more prominent ion (whether positive or negative) at the targeted area, therefore restricting the completion of the neutralization process to the non-conductive object.

Various methods have been developed in an attempt to prevent static electricity or contamination of electrodes from affecting the ion production. For example, U.S. Pat. No. 6,002,573 discloses disposing ionizing electrodes in an insulating housing so that the housing shields during the production of ions. The electrodes electrostatically charge the housing to repel the ionized air out of the housing toward a target.

Several methods and devices have been fashioned to constrain the ion content of the target region more balanced which are disclosed in U.S. Pat. Nos. 5,055,963 and 6,252,233. U.S. Pat. No. 5,055,963 discloses a self-balancing air ionizer contained in an insulating housing with an ambient air inlet and outlet. A fan is devised to intake ambient air into the housing unit, through an array of electrodes, and then projects the newly ionized air to a designated area. The device self-balances the ion content by isolating the high voltage side of the power supply, including the electrodes, from the ground and does not allow any D.C. charge to flow to the ground. The accumulation of one charge causes a bias charge on the production of the opposite charge; thus creating a balance of ion output and eliminating the need for ion sensors.

U.S. Pat. No. 6,252,233 to Good portrays a system for detecting and balancing the positive and negative ion outputs of an ionizing gun. Separate power supplies are used for the positive and negative ion generating electrodes, with a sensor disposed to detect the ion levels and adjust the power output of the power supplies, which in turn balances the ion output. Balancing the ion content using the above described methods have been fundamentally successful, however, some imbalances may still occur in the target location.

Finally, sensor detection allows for the detection of motion. Several ionization devices have been fashioned to allow for the input of a sensor detector structure. These additions detect motion in a designed located and therefore activate a particular action. In referenced U.S. Pat. No. 7,134,946, a proximity detector is disclosed in which activates the heater-blower motor and ionizer. U.S. Pat. No. 7,134,946 does not disclose an ionization nozzle, but rather an ionizer that is separate from a filtered air circulation system. The patent does include a source of clean dry air. Other relevant features are an enclosure which could be made from, inter alia, "electrostatic-discharge dissipative polymers". Several additional discovered patents refer to ionized air devices. However, the bulk of these teach systems for providing improved air flow, ion creation systems and power management systems.

U.S. Pat. No. 4,364,147, to Biedermann, describes an apparatus for blowing ionized air through a single air outlet. Biedermann particularly teaches the ability to transition from a laminar air flow output stream to a pulsed airflow output stream. Furthermore, the invention teaches the addition of ultrasonic radiation to the cleaning process. One embodiment of the Biedermann disclosure teaches pulsating the airflow and/or ultrasonic radiation in relation to a characteristic frequency of the material object of the object to be cleaned. In another embodiment of the Biedermann invention, the airflow is directed parallel to the object to be cleaned, while the ultrasonic radiation is directed normal to the airflow.

Additionally, U.S. Pat. No. 4,751,759, to Zoell, describes a cleaning apparatus having a single laminar airflow outlet and an adjoining suction nozzle. The airflow outlet may also have an ionizing element disposed within. Of particular note is the inclusion of a handle, which is assumed to be insulated, to make the cleaning apparatus portable.

And finally, U.S. Pat. No. 4,665,462 demonstrates an ionizing gas gun comprised of a plastic nozzle, filtration device for the same, a flow sensor, alarm signals and a trigger. Upon activation of the trigger, high voltage is supplied to the electrode and compressed air is supplied to the barrel of the gun. A filtration cartridge is used within the nozzle to maintain cleanliness of the electrode. Flow sensors and alarm signals are installed in order to monitor flow rates and ion output contents of the device.

None of the patents discovered during our search seem to illustrate a shell for insulting and supporting an existing destat device. Additionally, none of the patents discovered seem to contemplate the use of a bracket configuration or stand-off bracket in order to stabilize further an existing destat device. Finally, none of the patents discovered seem to contemplate the use of the combination of a sensor to trigger the flow of compressible air and associated ionization when an article is placed between the air outlets, two ionization nozzles, or plurality of the like, directed at each other, and additionally a frame with panels, enclosures and supports to both protect the existing destat device and the operator.

SUMMARY OF THE INVENTION

The major deficiencies the present invention addresses are (a) avoiding a high voltage shock for the handler, (b) building a more robust structure capable of use in an industrial environment and (c) building an enhanced equipment design to maximize efficiency, stability and reduce product "burnout".

These and other related objects are achieved by providing a walk-up, user accessible cleaning workstation having a sensor in combination with an ionization nozzle. The ionization nozzle is coupled via a valve to a remote source of compressed gas. The nozzle has an electrode and a hot lead connected to a power supply. A ground lead is also provided. A sensor simultaneously controls operation of the valve and the power supply.

A frame has a mounting panel for maintaining the sensor in a fixed position with respect to said nozzle. The frame includes a partial enclosure surrounding the nozzle to restrict user contact with said electrode. The frame has a support to collectively hold the sensor and nozzle in operative proximity to a cleaning area. Sensor detection of a workpiece in the cleaning area generates an activation signal for the valve and power supply so that a manually held work piece can be cleaned and destaticized while safeguarding the user from accidental contact with said electrode.

The support suspends the mounting panel above the cleaning area. During use the mounting panel deflects particles from the cleaning area. The mounting panel deflects dust that is blown off concavely shaped ophthalmic lenses. The remote source of compressed gas is clean dry air delivered to the nozzle below about 100 psi. The power supply provides a voltage on the order of 7 kV to the electrode along the hot lead. The sensor comprises an optical eye and reflector, and wherein the frame supports said reflector in operative alignment to said optical eye. There may be provided a second ionization nozzle. The support holds the second nozzle in a facing relationship to said nozzle. The cleaning area is located in between said nozzles and in between the optical eye and the reflector.

Rigid metal piping may be used for coupling the nozzle to the remote source of compressed gas. The frame includes an insulating section for separating the hot lead from the metal piping along at least a portion of their lengths. The insulating section may include a stand-off bracket which holds the hot lead at a preset distance from said rigid piping, so that the air gap therebetween exceeds an arcing distance. The frame encloses the rigid metal piping within the workstation.

Flexible hosing may be used for coupling the nozzle to the remote source of compressed gas. The frame supports said flexible hosing along at least a portion of its length. The hose is non-metallic, and is connected to the nozzle via a metal connector. A ground lead is connected between the metal connector and the power supply. The frame includes an insulating section that separates the ground lead from a hot lead of the power supply.

BRIEF DESCRIPTION OF THE DRAWINGS

The advantages, nature and various additional features of the invention will appear more fully upon consideration of the illustrative embodiments now to be described in detail in connection with the accompanying drawings. In the drawings, wherein like reference numerals denote similar components throughout the views.

DETAILED DESCRIPTION OF PREFERRED EMBODIMENTS

Figure 1:
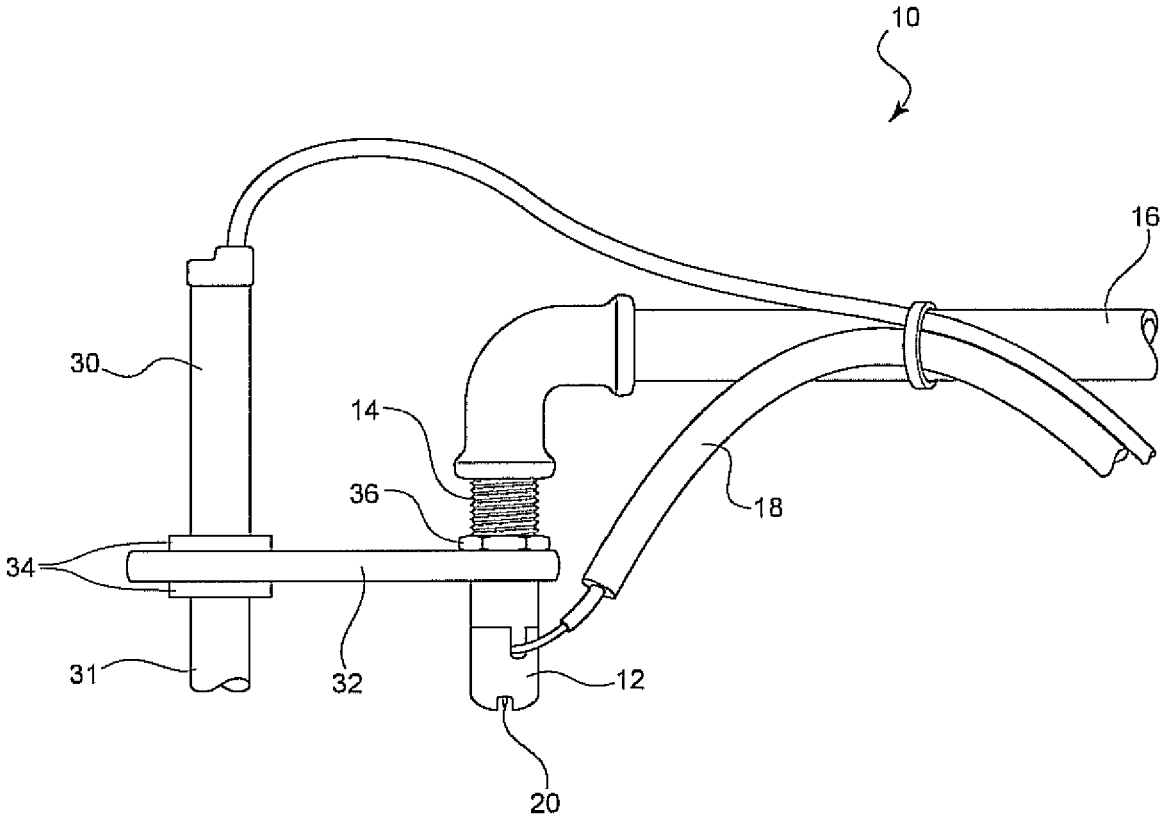
FIG. 1 is a side elevational view of a prior art individually mounted ionizing air nozzle.

Referring now in detail to the figures and in particular, FIG. 1, which illustrates an example of a prior art destaticizing station 10. An ionizing air nozzle 12 is shown, which are commercially available from SIMCO of Hatfield, Pa. These nozzles are intended to be mounted onto a threaded metal nipple 14. Nipple 14 is connected to rigid metal piping 16 which serves to deliver high pressure clean, dry air or gas to the nozzle. Piping 14 also constitutes an open, accessible ground that is connected to the ionization power supply. The 7 kV hot lead 18 of the power supply is strapped along piping 16 and connects to the nozzle 12 where it is electrically coupled to the ionizing electrode 20.

In order to reduce contamination and dust, some cleaning stations have been equipped with an optical sensor 30. For example, sensor 30 may include a light source which emits a beam of light which is directed at a reflector, not shown for the sale of clarity. Light is reflected back to the sensor, creating a "closed" circuit signal. When a workpiece or user's hand crosses the light path, the sensor detects the loss of reflected light and transmits an "open" circuit signal. The "open" circuit signal is used to control operation of the gas valve and power supply.

A bracket 32, made of metal, is mounted on nipple 14 with a first nut 36. A sensor aperture is formed on the opposite end to support sensor 31 with sensor nuts 34. Since nipple 14 is not designed as a support point, bracket 32 is precariously extending out in a cantilevered manner where it is subject to contact with personnel and equipment. Aside from the potential for damaging the sensor, the bracket serves as an excellent lever to overcome the moderate clamping force afforded by the hand tight nuts. Even grazing contact can cause the bracket to rotate out of alignment with its reflector, causing an erroneous "open" circuit condition, and initiating unwanted operation of the ionization nozzle.

Other incidental contact occurs between the operator and electrode 20 or piping 16 resulting in the user being shocked. Another electrical hazard results from the high voltage lead 18 being strapped to metallic pipe 16. Since the high voltage lead is parallel to the pipe in the vicinity of the strap, it creates a capacitive coupling. Invariably over time, high voltage leaks through the insulative sleeve of lead 18, and returns to the ground connection on the power supply, causing the power supply to burn out prematurely.

Figure 2:
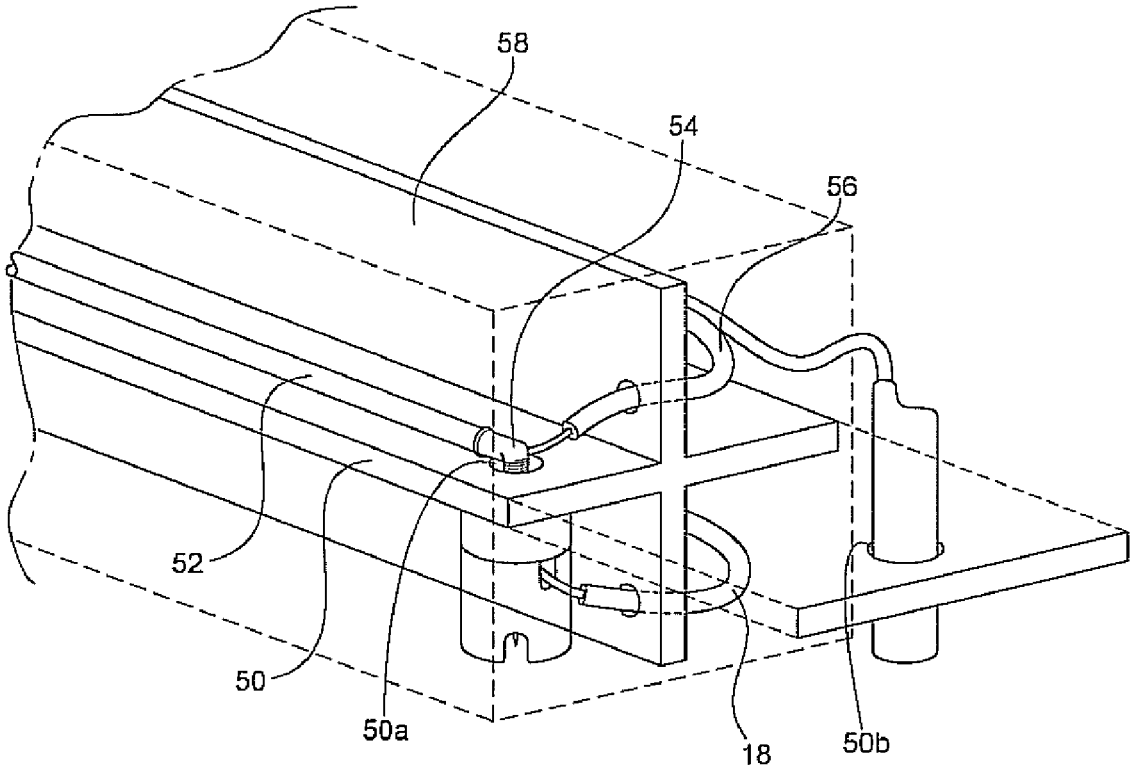
FIG. 2 is a perspective view of an embodiment of the invention illustrating an insulating panel having a nozzle and sensor mounted therein.

As shown in FIG. 2, in one embodiment of the invention, we have provided a rigid panel of insulating material. A horizontal panel 50 may be securely mounted at its back end to a support structure. A flexible tube 52 may know be provided to deliver the high pressure air or gas to nozzle 12. For example, a rubber hose 52 may be supported on top of panel 50 and be connected via a 90 degree elbow 54 to a nipple, on which the nozzle is mounted. There is provided a nozzle aperture 50*a* and a sensor aperture 50*b*. The elbow may pass through aperture 50*a* with sensor mounted in aperture 50*b* an operative distance away.

This arrangement eliminates a metal pipe support, and the related safety issues of having the metal pipe support serve as part of the ground loop. A ground lead 56 can be directly connected to the nipple or elbow 54. The hot lead 18 may be located below panel 50, separated from ground lead 56. Optionally, a vertical panel 58, also made from an insulating material, may be provided.

The panels may be an inert, rigid panel such as plastic, ABS, or SEABOARD. The properties of SEABOARD have been found to be suitable. For example, grade 1 ABS has a density of between 1.02 and 1.22 g/cc; hardness of between 87 and 118 according to Rockwell R; tensile strength @ yield of between 36 and 52; an electrical resistivity of $1\times10^{16}$ ohms; a dielectric constant of 2.9; a dielectric strength of between 15 and 35 kV/mm; and an arc resistance of 60 seconds. Materials having properties similar to ABS and SEABOARD will be suitable for use as mounting panels, enclosures and supports according to the invention.

For example, SEABOARD has physical properties of density at 0.960 g/cm$^3$ according to ASTM D 1505; hardness of 69 Shore D according to D 2240; environmental stress crack of 25 hrs. according to D 1693; and F50 resistance of greater than 55 hrs. according to D2561. Mechanical properties include tensile strength @ yield of 4,500 psi according to D 638; flexural modulus of 260,000 psi according to D 790; and flexural strength of 5,070 psi according to D 790. Thermal properties include F50 low temperature brittleness of −76 degrees C. according to D 746; heat deflection temperature @ 66 psi of 82 degrees C. according to D 648; and a Vicat softening point of 130 degrees C. according to D 1525.

Figure 3:
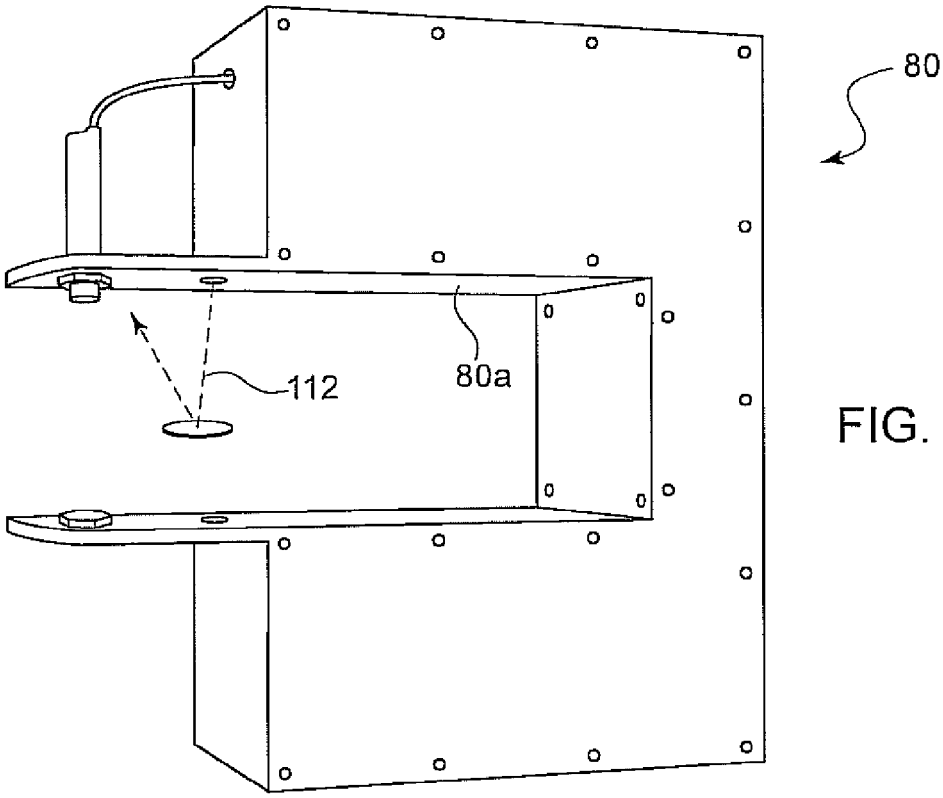
FIG. 3 is a side elevational view of an insulative panel housing to enclose the nozzle.

As shown in FIG. 3, the entire assembly of FIG. 2 may be enclosed within a housing 80. Portions of housing 80 are also shown in FIG. 2 in dashed line. Advantageously, housing provides a rigid support structure for the sensor, reflector and a second, lower ionization nozzle.

Figure 5:
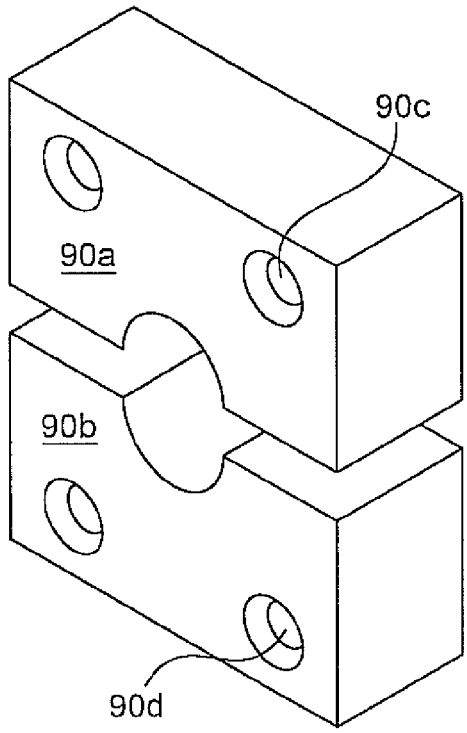
FIG. 5 is an exploded perspective view of a stand-off bracket.
Figure 4:
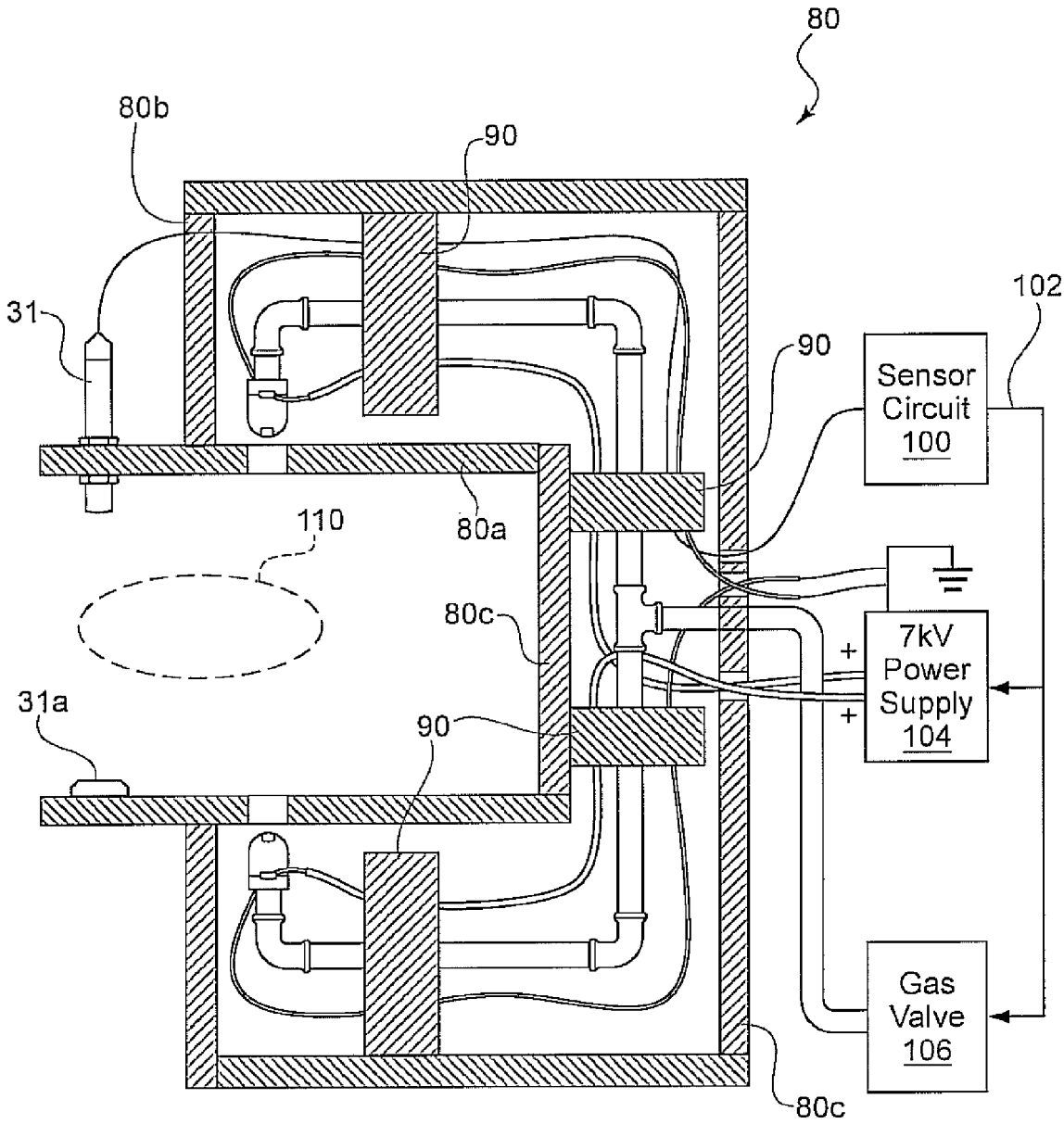
FIG. 4 is a side elevational view of an alternate embodiment of the invention illustrating a housed rigid conduit with brackets.

FIG. 4 shows an alternated embodiment of housing or frame 80 with one side panel removed. The frame includes a mounting panel 80*a*, a partial enclosure 80*b*, and a support 80*c*. For safety, or to meet regulatory requirements, certain cleaning stations will use rigid pipe. The electrical leads can be enclosed with the rigid pipe, and separated therefrom via stand off brackets. A more detailed view of the stand-off bracket is shown in FIG. 5. An upper section 90*a* is split from lower section 90*b* to accommodate the rigid piping. The leads can then be wired through the various bore holes 90*c* and 90*d*. The electrical leads can then be strung from bracket to bracket and held under slight tension away from each other and any metal conduit. The brackets allow the electrical leads and metal pipes to be routed in the same bays, while avoiding the contact illustrated in FIG. 1. Previous attempts to prevent arcing from the prior art arrangement, included routing the electrical leads in additional plastic tubing. The tubing has a high dielectric constant, characterized by 7.1 at 50 Hz, 6.6 at 1 kHz, and 5.5 at 10 MHz. Accordingly, the stand-off brackets need to create an air gap with an insulating property that exceeds that of the hose, as represented by its dielectric constant values.

As described earlier, FIG. 4 shows the sensor circuit 100. Preferably sensor 31 is an optical sensor that is aligned with a reflector 31*a*. When the cleaning station is idle, sensor 31 is receiving an optical signal that is reflected back from reflector 31*a*, which maintains the sensor circuit 100 in the closed state. When a workpiece is placed into the cleaning area 10, the optical signal path is interrupted and the sensor circuit 100 switches in to the "open" circuit state. In the "open" circuit state, a control signal 102 is communicated to the 7 kV power supply 104 and to the gas valve 106. Clean, dry air from a remote source at less than 100 psi is communicated through the valve and delivered to the one or two nozzles which may be present in the workstation.

At the same time, the power supply 104 is switched on, and 7 kV high voltage is provided to the nozzle electrodes. Clean, dry ionized air is therefore directed at the cleaning area 110 from either one or opposed sides. When cleaning ophthalmic lenses in cleaning area 110, the lens may have its concave side facing up. As can be seen in FIG. 3, the high pressure air stream 112 from the ionization nozzle can be deflected off the concave lens surface. As the user tilts the lens to see if all dust has been removed, the concave surface can deflect the dust-ridden air in a variety of angles, including angles directed at the user's face. Mounting panel 80*a* can partially block certain of these airstreams. It was also determined that mounting panel 80*a* acts as a baffle to disrupt the air stream, and protect the user, even if they were not directly in the path of the panel. It was also discovered that compared to the typical cylindrical chrome pipes, the matte surface of the housing or frame helped lens inspectors in another way. When workstations are located on or near the inspection stations, light can reflect off the chrome pipes and interfere with lens inspection. By enclosing portions of the workstation, the users are safely protected from electrical shock, dust-ridden airstreams. The rigidity between the mounting panels that hold the sensor and reflector eliminates accidental activation of the sensor circuit when the workstation is knocked and the optical beam loses sight of the reflector.

Having described preferred embodiments for cleaning workstations for ophthalmic lenses (which are intended to be illustrative and not limiting), it is noted that modifications and variations can be made by persons skilled in the art in light of the above teachings. It is therefore to be understood that changes may be made in the particular embodiments of the invention disclosed which are within the scope and spirit of the invention as outlined by the appended claims. Having thus described the invention with the details and particularity required by the patent laws, what is claimed and desired protected by Letters Patent is set forth in the appended claims.

What is claimed is:

1. A walk-up, user accessible cleaning workstation having a sensor in combination with a pair of ionization nozzles comprising:

a first and a second ionization nozzle both coupled via a valve to a remote source of compressed gas, and having electrodes connected to a power supply;

a sensor for simultaneously controlling operation of said valve and said power supply; and a frame having a mounting panel for maintaining said sensor in a fixed position with respect to one of said nozzles; a partial enclosure surrounding said nozzles to restrict user contact with said electrodes; and a support to collectively hold said sensor and said nozzles in operative proximity to a cleaning area, wherein said support holds said second nozzle in a facing relationship to said first nozzle;

wherein sensor detection of a workpiece in the cleaning area generates an activation signal for said valve and power supply so that a manually held work piece can be cleaned and destaticized while safeguarding the user from accidental contact with said electrode.

2. The workstation of claim 1, wherein said support suspends the mounting panel above the cleaning area.

3. The workstation of claim 2, wherein during use said mounting panel deflects particles from the cleaning area.

4. The workstation of claim 2, wherein said mounting panel deflects dust that is blown off concavely shaped ophthalmic lenses.

5. The workstation of claim 1, wherein said compressed gas comprises clean dry air delivered to the nozzle below about 100 psi.

6. The workstation of claim 1, wherein said power supply provides a voltage on the order of 7 kV to the electrode along a hot lead.

7. The workstation of claim 1, wherein the sensor comprises an optical eye and reflector, and wherein the frame supports said reflector in operative alignment to said optical eye.

8. A walk-up, user accessible cleaning workstation having a sensor in combination with ionization nozzles comprising:

first and a second ionization nozzle both coupled via a valve to remote source of compressed gas, and having electrodes connected to a power supply;

a sensor for simultaneously controlling operation of said valve and said power supply; and a frame having (i) mounting panels for mounting said sensor and said first and second nozzles, (ii) a partial enclosure surrounding said nozzles to restrict user contact with said electrodes, and (iii) a support to collectively hold said mounting panels so that said sensor and said nozzles are in operative proximity to a cleaning area, wherein said support holds said second nozzle in a facing relationship to said first nozzle, wherein sensor detection of a workpiece in the cleaning area generates an activation signal for said valve and power supply so that a manually held work piece can be cleaned and destaticized on opposite sides simultaneously.

9. The workstation of claim 7, wherein the cleaning area is located in between said nozzles and in between said optical eye and said reflector.

10. The workstation of claim 6, further including rigid metal piping for coupling said nozzle to said remote source of compressed gas, wherein said frame includes an insulating section for separating said hot lead from said metal piping along at least a portion of their lengths.

11. The workstation of claim 10, wherein said insulating section comprises a stand-off bracket which holds said hot lead at a preset distance from said rigid piping, so that the air gap therebetween exceeds an arcing distance.

12. The workstation of claim 11, wherein said frame encloses said rigid metal piping within the workstation.

13. The workstation of claim 1, further including flexible hosing for coupling said nozzle to said remote source of compressed gas, wherein said frame supports said flexible hosing along at least a portion of its length.

14. The workstation of claim 13, wherein the hose is non-metallic, and is connected to said nozzle via a metal connector.

15. The workstation of claim 14, wherein a ground lead is connected between the metal connector and the power supply.

16. The workstation of claim 15, wherein said frame includes an insulating section that separates the ground lead from a hot lead of the power supply.

* * * * *